United States Patent [19]

Hong

[11] Patent Number: 4,847,819

[45] Date of Patent: Jul. 11, 1989

[54] UNIVERSAL CLOCK HAVING MEANS FOR INDICATING ZONAL TIME IN OTHER GLOBAL TIME ZONES

[76] Inventor: Kuo-Hui Hong, 621 Tung Feng Road, Taiana, Taiwan, 700

[21] Appl. No.: 177,341

[22] Filed: Apr. 7, 1988

[51] Int. Cl.[4] ..... G04B 19/26

[52] U.S. Cl. ..... 368/21; 368/27

[58] Field of Search ..... 368/21, 27, 22–26

[56] References Cited

U.S. PATENT DOCUMENTS

| | | | |
|---|---|---|---|
| 693,953 | 2/1902 | Davis | 368/27 |
| 935,806 | 10/1909 | Olinger | 368/27 |
| 1,168,797 | 1/1916 | Giusto | 368/27 |
| 2,056,038 | 9/1936 | DeAngelis et al. | 368/27 |
| 2,395,643 | 2/1946 | Ramsay | 368/27 |

*Primary Examiner*—Bernard Roskoski

*Attorney, Agent, or Firm*—Fleit, Jacobson, Cohn, Price, Holman & Stern

[57] ABSTRACT

A clock or watch can display 24 local times of 24 selected cities or places around the world which represent the 24 time zones around the globe respectively, including the local time of the place where the user lives no matter where the user or the watch is in the world. In addition, an alarm time can be set for the local zonal time as well as for any other 23 zonal times in the world.

4 Claims, 3 Drawing Sheets

UNIVERSAL CLOCK HAVING MEANS FOR INDICATING ZONAL TIME IN OTHER GLOBAL TIME ZONES

BACKGROUND OF THE INVENTION

The present invention is a clock or watch which can show the local time as well as the times of the other 23 time zones around the globe.

The conventional clock or watch can show only the local time, although the lately invented clocks for travelling use can show one or two times other than the local time. However none of them can show the 24 times, one for each time zone around the whole world, but the present invention does.

SUMMARY OF THE INVENTION

The present invention has a rotating ring with 12 names of places, one place for each one hour lapsed, marked along the outer margin of the ring, and another 12 names of places marked along the inner margin of the ring. The selected 24 names of places in the world represent the 24 time zones respectively. When the hour disk (instead of the hour hand in the conventional clock) runs on time, therefore, the times at the places located at each time zone are shown.

The object of the present invention is to provide a clock or watch showing 24 times for the 24 time zones around the globe, including the local time of the place where the user dwells. Obviously, the advantages of the present invention are suitable for anyone, traveller or non-traveller, to use, especially for the person who travels around the world very often, such as crews at sea, or in the air or people with business everywhere around the world from time to time.

The names with their assigned numbers of the members or parts of the embodiment of the present invention shown in the Figures are listed below:

1. Outer-circle names of places,
2. Inner-circle names of places,
3. Name-of-place ring,
4. Alarm disk,
5. Hour disk,
6. Alarm hand,
7. Alarm lines (1–12),
10. Inner number (1–12),
11. Back plate,
12. Name-of-plate ring,
13. Cover,
14. Hour hand,
14. Outer numbers (1–12),
17. Second hand,
18. Minute hand,
19. Mechanism case,
21. Time zone without important place,

22. Time zone without important place,
23. Front plate,
24. Shell.

DESCRIPTION OF THE PREFERRED EMBODIMENT

Figure 2:
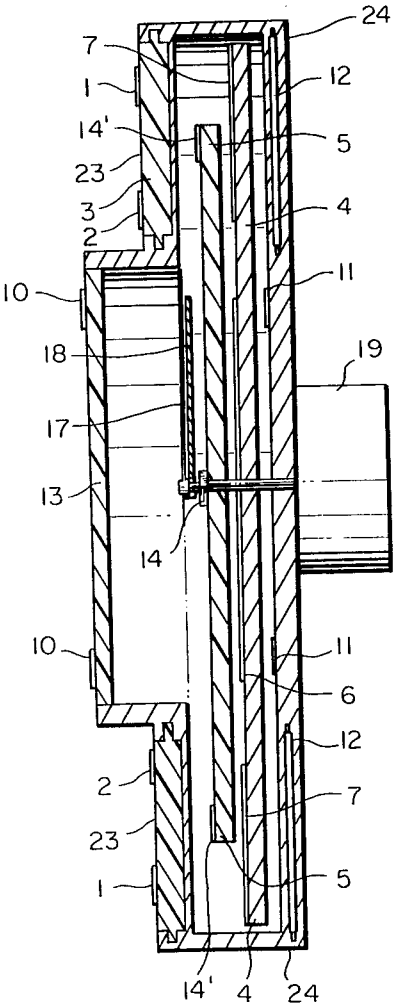
FIG. 2 is a side view of the embodiment of the present invention.
Figure 3:
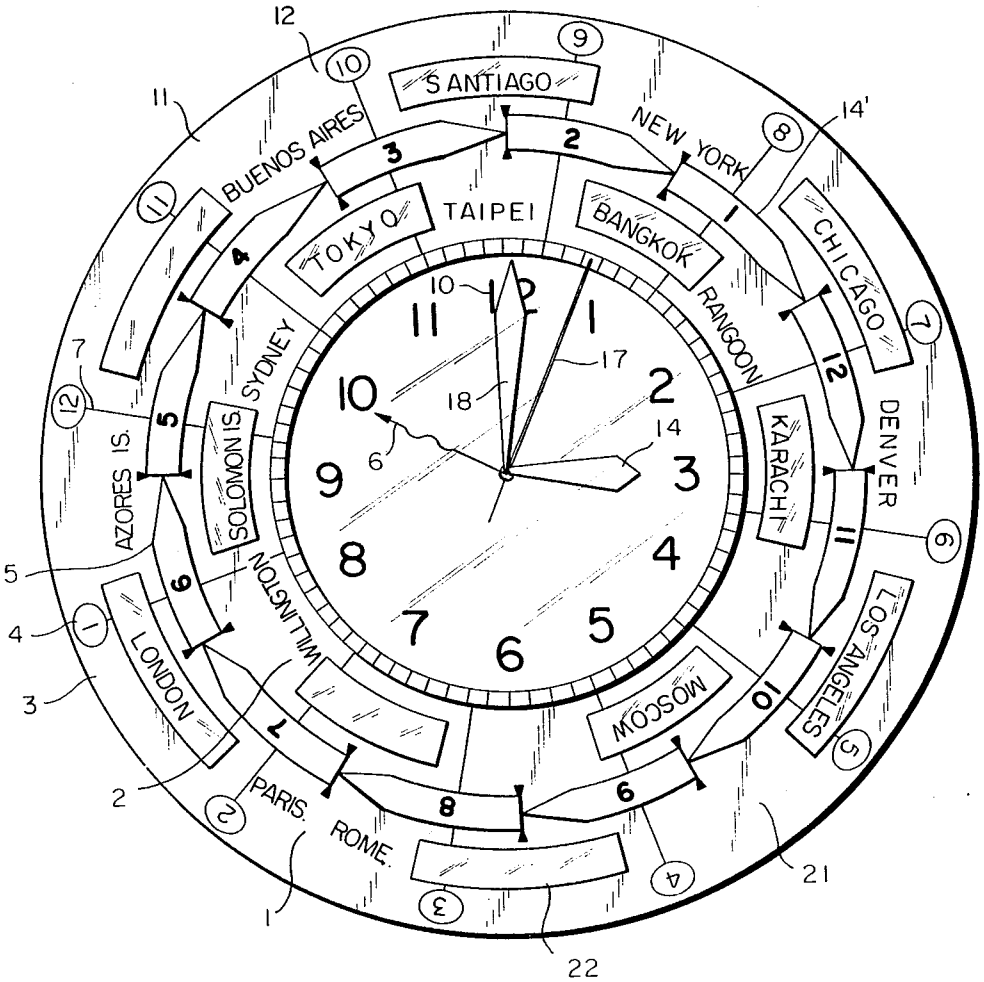
FIG. 3 is a top view of the embodiment of the present invention.

The general construction of the embodiment of the present invention is shown in FIGS. 2 and 3. There is an hour disk 5 on which an hour hand 14 is marked or printed, and it can be used as a conventional hour hand so that the hour hand in a conventional timing device can be replaced by the hour disk 5 with the marked hand 14 in the present invention. For the same reason the alarm disk 4 can be used as a conventional alarm hand and substitute for the alarm hand (see FIGS. 2 and 3). The alarm disk 4 is set under the hour disk 5 and the hour disk 5 must be transparent.

Therefore all the mechanical design of the present invention inside the mechanism case 19 (see FIG. 2) can be exactly the same as that of a conventional clock or watch.

Figure 5:
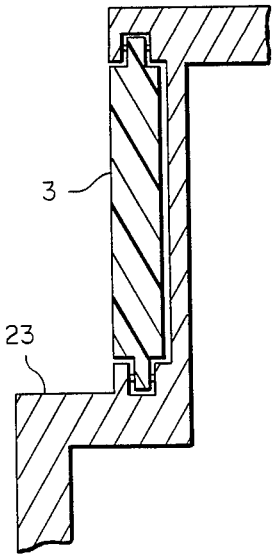
FIG. 5 shows the structure of the name-of-place ring in detail.

Furthermore, another new feature of the present invention is the name-of-place ring 3 which is inserted in the front plate 23 of the shell 24 (see FIGS. 2, 3 and 5). However, when the hour disk 5 and alarm disk 4 are made of transparent material, the name-of-place ring 12 is inserted in the back plate 11 of the shell 24 and substitutes for the former ring 3. No matter which ring 3 or 12 is adopted, the ring 3 or 12 can be turned or set manually. On the ring 3 there are 24 names of cities or places marked or printed, half of them along the outer circumference and the other half of them along the inner circumference. They are placed equally apart (Details described in the later paragraphs).

The present invention can be used as an ordinary clock or watch when based on the inner numbers (1–12) 10 printed on the cover 13. The hour hand 14 (on the hour disk 5), the minute hand 18 and the second hand 17 are set to the local time (e.g. Taipei time in FIG. 3) in the conventional way, meanwhile the name of Taipai on the name-of-place ring should be set at (or turned to) the topmost position (i.e. exactly at the north position) by hand (as shown in FIG. 3). When doing this setting the inner numbers (1–12) 10 on the cover 13 are used. The alarm band 6 can be set in the same way as described above or in the same way as with an ordinary clock.

Figure 1:
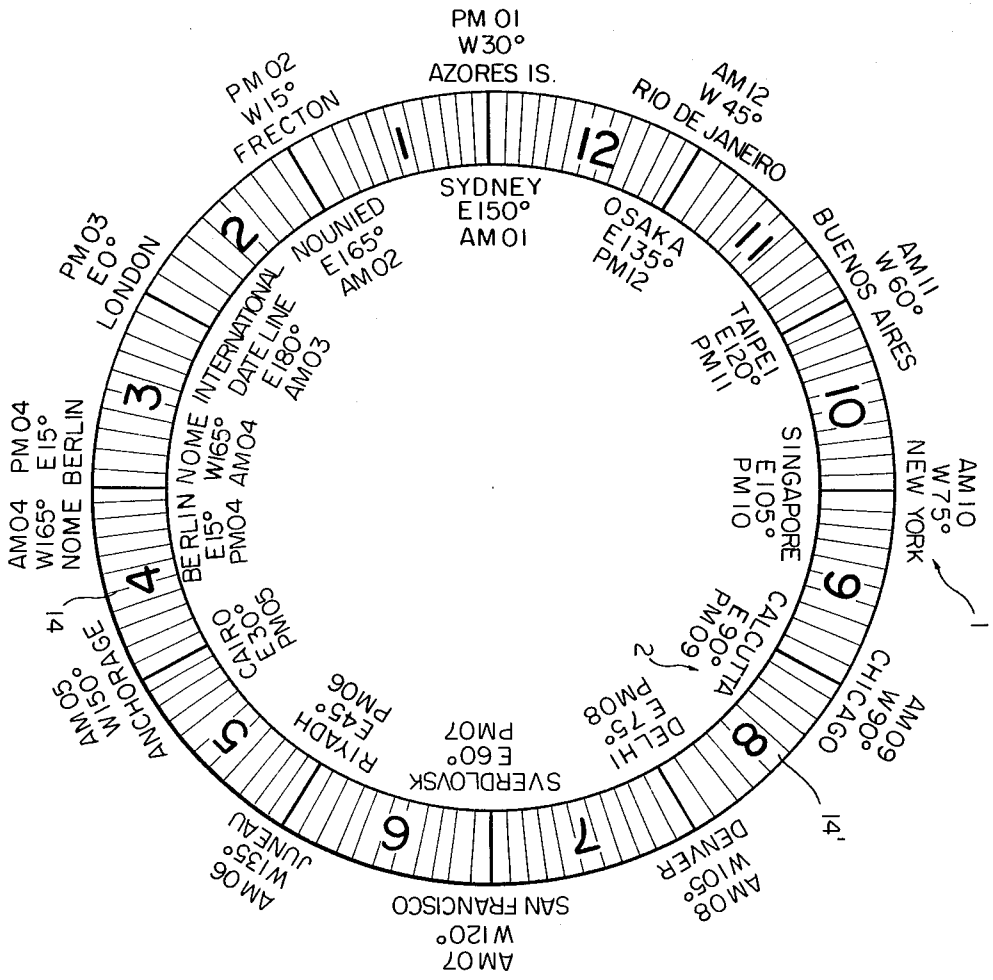
FIG. 1 shows the arrangement of the 24 places representing the 24 time zones around the globe respectively.

Referring to FIG. 1, there are 12 outer-circle names of places 1 and another 12 inner-circle names of places 2 marked or printed on the name-of-place ring 3 equally apart. The 24 cities or places are so selected that they represent the 24 time zones on the earth respectively. The arrangement of the names of the 24 cities or places is in the order of time and described in the following paragraph.

If the clock or watch is used by a person who dwells in New York (see FIG. 1), for example (for theoretical discussion only), then the name of New York (on the outer side) is set by hand to the topmost position or at the exact north position. However, if the name of the place where the user lives is not selected and marked on the timing device, then the one of the 24 selected names which is in the same time zone as where the user lives is used. The New York name can represent the time zone of west longitude 75° and its local time is supposed to be 10 a.m. (indicated by the outer numbers (1–12) 14' marked or printed on the hour disk 5) at the moment. Therefore the local time of Chicago (representing the next time zone of 90° W) should be 9 a.m.. For the same reason, with one hour per time zone (15° of longitude), the local time for Nome (165° W is 4 a.m.. Continuing on but with chaning to the readings along the inner side, then we know the local time for the "International Date Line" (180° E) is 3 a.m., for Noumea (165° E) it is 2 a.m. and so on, up to 10 p.m. at Singapore (105° E). Therefore it covers exactly one-half of the globe, or 180° of longitude or 12 hours (or half a day).

However, in the opposite way, we know that the local time for Buenos Aires (on the outer side and representing the time zone of 60° W) is 11 a.m. and so on, up to 4 p.m. at Berlin (15° E). Continuing on but changing to the readings along the inner side, we can read 5 p.m. at Cairo (30° E), and so on, up to 10 p.m. at Singapore (105° E). Therefore it covers exactly the other one-half of the globe, or 180° of longitude or 12 hours (or half a day). Thus it can be concluded that on this clock or watch we know the local time of each of the 24 time zones around the world at any given instant, of course including the user's own local time.

The present invention can be constructed as shown in FIGS. 2, 3, and 5 and can be made in the shape of a watch, a clock or the like.

The two sets of names of the cities or places marked or printed equally apart in FIG. 1 and on the ring 3 in FIG. 3 are obtained only from a world map, to show exactly the same arrangement of the 24 time zones in the world. The cities and places selected and shown in FIG. 1 may be more correct than that in FIG. 3 and are preferred to be referred to and used when manufacturing the invention. Even so the local times of those cities or places shown in FIG. 1 may only be theoretically correct but may not be actually correct. However, these cities and places should be checked with their actual zonal time when the timing device is manufactured.

When manufacturing the invention, the marked times in FIG. 1 should be removed, and only the names of the cities and places and/or the corresponding degrees of longitude are left.

The name-of-place ring 3 can be turned or set by hand and the name of the city or place where the clock or watch is currently located should be always kept at the topmost position (or the exact north position). The detailed construction of the ring 3 is shown in FIG. 5.

On the hour disk 5 an hour hand 14 is marked or printed and along its circumference the outer numbers (1–12) 14' are also marked. The hour disk 5 must be made of transparent material, so that the alarm hand 6 and alarm lines (1–12) 7, both of which are marked or printed on the alarm disk 4, can be seen (see FIGS. 2 and 3).

Figure 4:
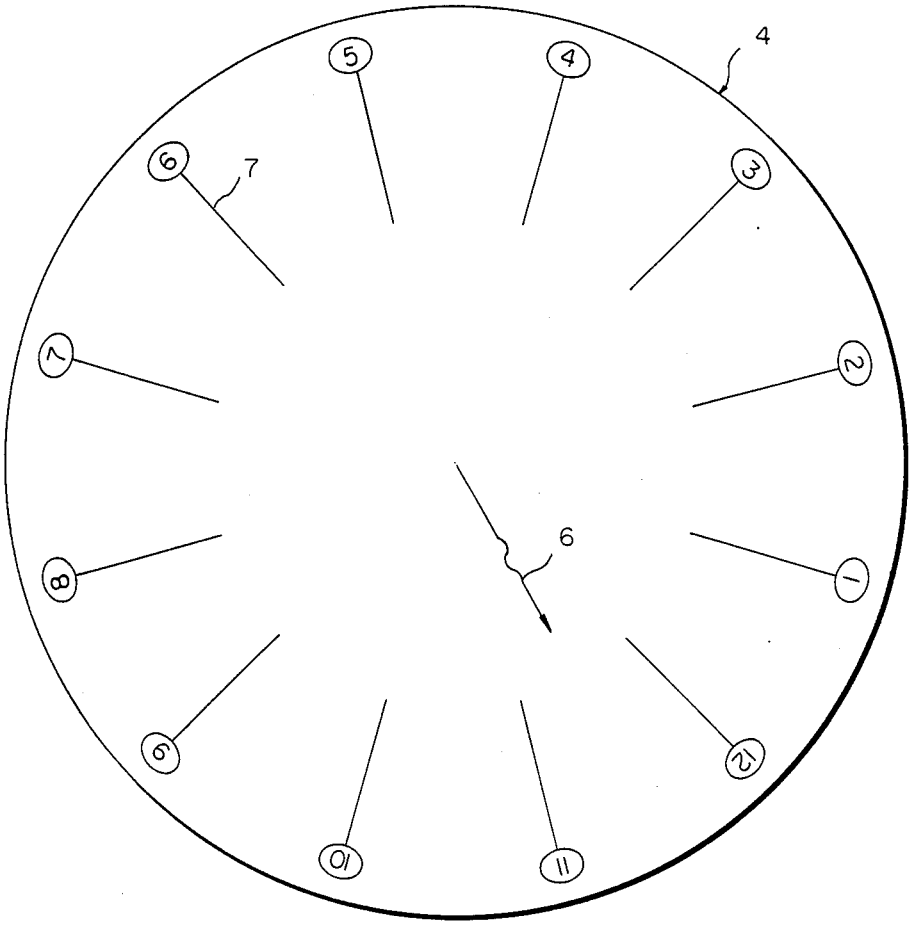
FIG. 4 shows the position of the alarm hand on the alarm disk.

On the alarm disk 4 an alarm hand 6 and the alarm lines (1–12) 7 are marked or printed equally apart (see FIGS. 2, 3 and 4). The alarm hand 6 must be in between the alarm line (11) and the alarm line (12) due to time difference (see FIG. 4). For example, if the alarm hand 6 is set at 9:50 (approximately) according to the local zonal time (see FIG. 3), the alarm buzz will sound, of course, at 9:50 of the user's local time. Meanwhile the alarm buzz will sound at 12:50 for the Azores Islands, at 7:50 for Chicago, at 5:50 for Los Angeles, at 1:50 for Wellington, and so on (see FIG. 3). All of the alarm times as described above are not shown as to whether they are a.m. or p.m. by the timing device itself but can be easily known by the user's mental arithmetic.

On a wristwatch or a small alarm clock it will be too crowded to be seen clearly if all 24 names of cities or places as shown in FIG. 1 or 3 are marked or printed on the name-of-place ring 3. Then, the ring 3 can be neglected and 12 selected names from the 24 names are marked or printed equally apart on the hour disk 5 for clarity. The 12 names are so selected that each of them represents one different time zone regardless of whether a.m. or p.m. (i.e. only one of the two cities or places spaced apart by 180° of longitude being selected). Therefore the a.m. or p.m. status should also be calculated mentally. Now the hour hand 6 should be marked or printed at the position pointing to the name of the city or place of the same time zone as where the user is. If the user moves to another city or place, the hour hand 6 should be correspondingly changed.

The time zones without important places 21 and 22 are now shown as being left blank but can be filled with same time-zone cities when manufacturing the device (see FIG. 3).

For practical use, an example is given as follows:

The name of the user's city or place (or the name of a city or place in the same time zone) on the name-of-place ring is turned to or set at the topmost position (exactly at the north position) firstly, taking New York (on the outer circumference, representing 75° west longitude (75° W), and 10 a.m. at a certain instant) for example, another 12 cities or places to the west of New York can be put successively and equally apart, one city or place representing one time zone (or apart about 15° of longitude), and they are, in order of time, Chicago (90° W, 9 a.m.), Denver (105° W, 8 a.m.) etc., up to Nome (165° W, 4 a.m.), and then changing to the readings along the inner circumference and going on, the International Date Line (180° W or E, 3 a.m.), Noumea (165° E, 2 a.m.), Sydney (150° E, 2 a.m.) etc., up to Singapore (105° E, 10 p.m.); In the opposite way, another 11 cities or places (the 12th one, Singapore, being already chosen before) to the east of New York can be put successively and equally apart, and they are, in order of time, Buenos Aires (60° W, 11 a.m.), Rio de Janeiro (45° W, 12 a.m.), etc. up to Berlin (15° E, 4 p.m.), and then changing to the readings along the inner circumference and going on, Cairo (30° E, 5 p.m.), Riyadh (45° E, 6 p.m.), etc., up to Singapore (105° E, 10 p.m.). Therefore the 24 zonal times around the world, represented by 24 big cities or places in the world, are given on the present invention at any given instant.

I claim:

1. A timing device usable as a clock or watch, comprising:

a case accommodating a timing mechanism of conventional construction provided with a settable hour hand arbor rotating one revolution every twelve hours, an alarm hand arbor settable to a desired alarm time rotational position for sounding an alarm when the hour hand arbor rotational position corresponds therewith, a minute hand arbor carrying a minute hand and rotating once every hour, and a second hand arbor carrying a second hand and rotating once every minute;

a shell carrying said timing mechanism case, said shell having a back plate and a front plate;

a transparent cover plate fixed centrally in said shell front plate, said cover plate having circularly arranged thereon twelve equally spaced hour number markings consisting of the numbers 1–12 with the number 12 topmost;

a transparent hour disk mounted on the hour hand arbor for rotation therewith, the hour disk having marked thereon an hour hand marking, the hour disk further having marked along a circumference thereof twelve equally spaced numerals 1–12 with the numeral 12 being aligned with said hour hand marking;

an alarm disk mounted behind the hour disk on the alarm hand arbor and rotatable with the alarm hand arbor, the alarm disk having marked thereon an alarm hand marking, the alarm disk further having marked around a circumference thereof twelve equally spaced radial alarm line markings respectively numbered 1–12, said alarm hand marking being marked between the alarm line marking numbered 11 and the alarm line marking numbered 12; and a name-of-place ring freely rotatably carried in said shell radially outwardly of said cover plate, said name-of-place ring having marked therearound at least one set of twelve equally spaced place name markings, each of said place name markings corresponding respectively to a different global time zone, said place name markings being arranged in order of zonal time sequence.

2. A timing device according to claim 1, wherein said name-of-place ring has an inner set of twelve equally spaced place name markings marked around an inner circumference thereof and an outer set of twelve equally spaced place name markings marked around an outer circumference thereof, corresponding ones of said inner and outer place name markings respectively representing global time zones separated by 180° of longitude.

3. A timing device according to claim 1, wherein said name-of-place ring is rotatably carried in the front plate of said shell.

4. A timing device according to claim 1, wherein said name-of-place ring is rotatably carried in the back plate of said shell, and wherein said alarm disk and said front plate are transparent.

* * * * *